US005388960A

United States Patent [19]

Suzuki et al.

[11] Patent Number: 5,388,960

[45] Date of Patent: Feb. 14, 1995

[54] FORCED-AIR COOLING APPARATUS OF STEAM TURBINE

[75] Inventors: Atsuhide Suzuki, Yokohama; Shinya Ayano, Fujisawa; Yukio Shinozaki, Kawasaki; Shigeo Hosoi, Yokohama, all of Japan

[73] Assignee: Kabushiki Kaisha Toshiba, Kawasaki, Japan

[21] Appl. No.: 131,593

[22] Filed: Oct. 5, 1993

[30] Foreign Application Priority Data

Oct. 5, 1992 [JP] Japan ..... 4-288147

[51] Int. Cl.[6] ..... F01D 21/00; F01D 25/08; F01D 25/26

[52] U.S. Cl. ..... 415/176; 415/108; 415/118; 415/175; 60/646

[58] Field of Search ..... 415/108, 115, 116, 118, 415/175, 176, 177, 178, 179; 60/646, 657

[56] References Cited

PUBLICATIONS

Hother-Lushington, et al., "Forced Air Cooling of Steam Turbines", Convention on Steam Plant Operation, Conference Publication 12, pp. 199-204, 1973.

C. Cantuniar, "Accelerated Cooling of High-Output Turbines", Brown Boverie Rev., vol. 63, No. 2. pp. 141-147, 1976.

Zwangsabkuehlung von Turbinen der 500-MW-Bloecke durch Ansaugen van Luft, Energietechnik vol. 34, No. 7, pp. 241-245, 1984.

*Primary Examiner*—John T. Kwon
*Assistant Examiner*—Michael S. Lee
*Attorney, Agent, or Firm*—Foley & Lardner

[57] ABSTRACT

A forced-air cooling apparatus is provided for a steam turbine which comprises an outer casing composed of upper and lower casing halves, an inner casing composed of upper and lower casing halves and disposed inside the outer casing and a rotor coaxially disposed inside the inner casing for forming a steam flow passage between the inner casing and the rotor and in which steam introduced into the steam flow passage from a steam inlet portion is impinged against blades of the rotor to impart a turning force thereto as a movable portion such as rotor with respect to a stationary portion such as an inner casing. The forced-air cooling apparatus comprises a cooling passage including a first cooling air passage formed between the inner casing and the rotor and a second cooling air passage formed between the outer casing and the inner casing, an external air inlet and outlet portion for charging external cooling air into the first and second cooling air passages during the turning operation period and discharging the cooling air after passing the first and second cooling air passages and a control unit for controlling the flow rate of the cooling air passing the first cooling air passage in response to a signal corresponding to a differential expansion detected by a differencial expansion detector between the movable portion and the stationary portion of the turbine and controlling a flow rate of the cooling air passing the second cooling air passage in response to a signal corresponding to a temperature difference between the upper and lower casing halves of the outer casing of the turbine.

7 Claims, 11 Drawing Sheets

FORCED-AIR COOLING APPARATUS OF STEAM TURBINE

BACKGROUND OF THE INVENTION

The present invention relates to a forced-air cooling apparatus of a steam turbine in a high temperature state just after an operation shutdown of the steam turbine and, more particularly, to a forced-air cooling apparatus of a steam turbine having a double casing structure capable of safely and quickly cooling the turbine.

Generally, a steam turbine system is composed, as shown in FIG. 10, of a high-pressure turbine 1, an intermediate-pressure turbine 2 and a low-pressure turbine 3, and the high-pressure turbine 1 and the intermediate-pressure turbine 2 may be connected together through a common shaft or through two shafts.

Referring to FIG. 10, reference character A represents a boiler, and a main steam generated by the boiler A is supplied into the high-pressure turbine 1 through a main steam inlet portion of the turbine 1 by way of a main steam line 4, a main steam stop valve 5 and a main steam governing or control valve 6. The main steam, after the working in the high-pressure turbine 1, is then exhausted through a steam outlet portion into a high-pressure outlet line 7. The steam exhausted into the high-pressure outlet line 7 is heated by a reheater B and the reheated steam is then supplied into the intermediate-pressure turbine 2 through a reheated steam inlet portion thereof by way of a combined reheater valve 8. The steam, after the working in the intermediate-pressure turbine 2, is exhausted into a cross-over line 9 through a steam outlet portion of the turbine 2 and then supplied into a low-pressure turbine 3. The steam, after working in the turbine 3, is then passed to a condenser 10. Further, a degree of vacuum condition in the condenser 10 is maintained by a vacuum pump 11.

The high-pressure turbine 1 in FIG. 10 has a double casing structure such as shown in FIG. 11 as one example. Referring to FIG. 11, the steam from the boiler A is introduced into the high-pressure turbine 1 in a manner such that the steam enters through the control valve 6 into either of the main steam inlet portions 12*a* of a high-pressure outer casing 12 and then into a high-pressure inner casing 13. The steam entering the high-pressure inner casing 13 then passes through nozzles 13 fixed to the inner casing 13 and turbine blades 14*a* fixed to a rotor 14, as shown by arrows, in a steam flow passage and imparts a rotating force to the high-pressure rotor 14. During this operation, the pressure and the temperature of the steam lower and the steam then flows into the reheater B from a main steam outlet portion 12*b* through the high-pressure turbine outlet line 7.

In a case where the steam turbine system of the structure described above is periodically inspected or dismantled because of any failure or maintenance, the steam turbine system must be shutdown in its operation and the highly heated portions of the steam turbine then must be cooled to a point where dismantling can begin, thus being inconvenient and troublesome. For this purpose another apparatus for cooling the turbine system is required.

The temperature of the supplied steam is about 300° C. which is relatively low, so that the cooling thereof can be done for a relatively short period by natural cooling the low-pressure turbine 3 after the operation shutdown thereof, thus no specific cooling apparatus being required.

On the other hand, the high-pressure turbine 1 and the intermediate-pressure turbine 2, into which the main steam from the reheater B reheated in temperature to about 500–600° C. and the reheated steam are supplied, respectively, are under highly heated when these turbines 1 and 2 are shutdown in operations. Particularly, in the high-pressure turbine 1 in highly heated, the wall of the inner casing 13 is made thick in order to withstand the high-pressure steam. Accordingly, it takes a long cooling period to lower its temperature to a temperature suitable for the dismantling thereof through the natural cooling of the turbine. For this reason, the inspection or maintenance of the high-pressure turbine will have to be done after a relatively long period natural cooling of the turbine and the operation of the turbine system must be shutdown for a considerable long period, thus being inconvenient for the power supply, for example.

In view of the above fact, in a conventional technique, the shortening of the cooling period for the high-pressure turbine has been attempted by drawing air through a safety valve disposed in the outlet line of the high-pressure turbine and discharging the air into the condenser from the main steam line. (For example, see Accelerated Cooling of High-Output Turbines, Brown Boveri Rev. Vol. 63, No. 2, pp. 141–147, 1976; Forced Air Cooling of Steam Turbines, Convention On Steam Plant Operation, Conference Publication 12, pp. 199–205, 1973; Zwangsabküehlung yon Turbinen der 500-MW-Blöecke durch Ansaugen van Luft, Energietechnik Vol. 34, No. 7, pp. 241–245, 1984).

However, such conventional forced-air cooling apparatus for the turbine system has the following drawbacks.

First, according to the conventional technique, as disclosed in the Japanese Patent Laid-Open Publication Nos. 56-32014, 56-162212 or Japanese Patent Publication No. 3-4723, there is provided a system in which air for cooling is charged through the high-pressure outlet portion at relatively low temperature during the steady running period of the turbine system and the air is then discharged through the main steam inlet portion. However, in such system, the cooling air passes through a turbine steam passage from a reverse direction with respect to a normal steam flow direction in turning operation, so that a large volume of air necessary for the cooling is not passed and, hence, it is difficult to shorten the period for cooling the turbine. In the conventional technique described above, the reason why the cooling air is charged through the high-pressure discharging portion and the air is discharged through the steam inlet portion is considered to suppress thermal distortion or thermal stress of the turbine which may occur at the period of forced-air cooling operation. However, this will be disregarded for the following reason.

Namely, thermal distortion or thermal stress of the extent causing fatigue to elements or members of the turbine will never occur by cooling, for about one day by forced-air cooling the high-pressure turbine under the high-temperature shutdown of about 500–600° C. during the turbine operation period. This will be easily assumed from the fact that thermal distortion or thermal stress occurring at the time the steam turbine under the completely cooled operation starts to be driven with an operation starting period of about 8 to 16 hours to increase its temperature to about 500–600° C. is within an allowable range.

Accordingly, it is not necessary to have a structure, as disclosed in the Japanese Patent Publication mentioned above to charge the external air through the high-pressure outlet portion by means of an air drawing apparatus connected to the main steam inlet portion, and in such structure, since a large volume of air necessary for sufficiently cooling the turbine cannot be passed, it takes a long period to cool the turbine to a temperature suitable for dismantling the turbine.

Secondarily, in the conventional technique such as disclosed in the Japanese Patent Publication mentioned above, a rotor is cooled faster than the cooling of a stationary portion such as an inner casing, which causes a differential expansion between the rotor and the stationary portion, which may cause a problem such that the rotor now in the turning operation comes in contact with a nozzle. Namely, since the air for cooling is discharged externally through the inside of the inner casing, the rotor having a surface area larger than that of the inner casing and a weight less than that thereof and blades mounted to the rotor are subjected to large cooling effect and, hence, the rotor and its blades are cooled faster than the inner casing. Because of this reason, the thermal expansion of a movable portion such as rotor is lowered faster than that of a stationary portion such as inner casing, thus causing the differential expansion therebetween.

As is generally known, the rotor and the nozzle of the turbine are so arranged in design that both are opposed in position with an axial, i.e. longitudinal direction of the rotor, with small clearance therebetween to the extent that both prevent to contact each other even from internal temperature change at a load varying period during a normal operation period. Accordingly, at the forced-air cooling period, if the rotor is cooled faster than the inner casing, the differential expansion between the rotor and the nozzle is caused, which may result in the rotor now in the turning operation contacting the stationary nozzle, which may cause a possibility of damaging the nozzle.

Furthermore, the high-pressure turbine having an inner casing in which a nozzle is provided is constructed such that a small radial clearance between the nozzle and the outer tips of the blades mounted to the rotor and a small radial clearance between a rotor shaft and a labyrinth packing provided for the inner periphery of the nozzle have proper distances so as to prevent to come in contact with each other during the steady operation period of the turbine. Because of this reason, there is caused a temperature difference between upper and lower halves of the casings, further causing a difference in their thermal expansion and, hence, deforming of the casing such as a round-shouldered shape, which may come in contact between the rotating rotor shaft and the stationary labyrinth packing or between the outer peripheries, such as its radial and axial directions of the blades and the nozzle.

SUMMARY OF THE INVENTION

The present invention was conceived in view of the problems encountered in the prior art as described above and an object of the present invention is to provide a forced-air cooling apparatus of a steam turbine capable of cooling the turbine with a short period and effectively preventing the movable portion of the turbine in turning operation from being damaged through contact with stationary portions such as casings and nozzles.

This and another object of the present invention can be accomplished by providing a forced-air cooling apparatus of a steam turbine which comprises an outer casing composed of upper and lower casing halves, an inner casing disposed inside the outer casing and a rotor coaxially disposed inside the inner casing for forming a steam flow passage between the inner casing and the rotor and in which steam introduced into the steam flow passage from a steam introducing portion is impinged against blades of the rotor to thereby impart a driving force to a movable portion with respect to a stationary portion of a turbine, the steam turbine is cooled during the turning operation period of the steam turbine, and the steam is thereafter exhausted through a steam outlet portion, the forced-air cooling apparatus comprising:

a cooling passage means including a first cooling air passage formed between the inner casing and the rotor and a second cooling air passage formed between the outer casing and the inner casing;

means for charging external cooling air into the first and second cooling air passages during the turning operation period;

means for externally discharging the cooling air after passing the first and second cooling air passages;

means for detecting differential expansion between the movable and the stationary portions;

means for detecting a difference in temperature between the upper and lower casing halves of the outer casing; and a control means for controlling the flow rate of the cooling air passing the first cooling air passage in response to a signal corresponding to the difference from the differential expansion detection means and controlling the flow rate of the cooling air passing the second cooling air passage in response to the temperature difference from the temperature difference detection means.

In a preferred embodiment, the forced-air cooling apparatus further comprises a first air charging means provided for the steam inlet portion for charging air into the first cooling air passage, an air discharging means provided for the steam outlet portion for discharging the air externally, and a second air charging means provided for the outer casing for charging the air into the second cooling air passage, the air passing through the second cooling air passage being discharged through the air discharging means.

In a modified embodiment, the forced-air cooling apparatus further comprises an air charging means provided for the steam outlet portion for discharging air into the first cooling air passage, a first air discharging means provided for the steam inlet portion for externally discharging the air and a second air discharging means provided for the outer casing for discharging an air charged through the air charging means and passing the second cooling air passage, the air passing through the second cooling air passage being discharged through the air discharging means.

In another modified embodiment, the forced-air cooling apparatus further comprises means provided for the outer casing for charging air into the second cooling air passage, the air being then supplied to the first cooling air passage, a first air discharging means provided for the steam inlet portion for discharging the air and a second air discharging means provided for the steam outlet portion for discharging the air charged into the second air cooling passage as occasion demands.

Regarding the air flow rate control, a first flow rate control valve is disposed for the first cooling air passage for controlling air flow rate in the first cooling air passage, the control means controlling the first flow rate control valve in comparison with a predetermined set value regarding the differential expansion between the movable and the stationary portions of the steam turbine from the reference point and detected by the differential expansion detection means, and a second flow rate control valve is disposed for the second cooling air passage for controlling cooling air flow rate in the second cooling air passage, the control means controlling the second flow rate control valve comparison with a predetermined set value regarding the difference in temperature between the upper and lower casing halves from the temperature difference detection means.

According to the forced-air cooling apparatus of the steam turbine of the structures described above, the external cooling air is charged into the first and second cooling air passages and, after achieving the cooling function, the air is discharged. During this flow of the cooling air, the cooling air in the first cooling air passage is controlled in flow rate in response to the differential expansion between the movable portion and the stationary portion of the turbine, and the cooling air in the second cooling air passage is controlled in flow rate in response to a signal corresponding to the temperature difference between the upper and lower casing halves of the outer casing. Accordingly, even in the forced-air cooling operation, the movable portion never come in contact with the stationary portion, thus remarkably shortening the cooling period of the steam turbine.

The nature and further features of the present invention will be made more clear from the following description with reference to the accompanying drawings.

DESCRIPTION OF THE PREFERRED EMBODIMENTS

Figure 1:
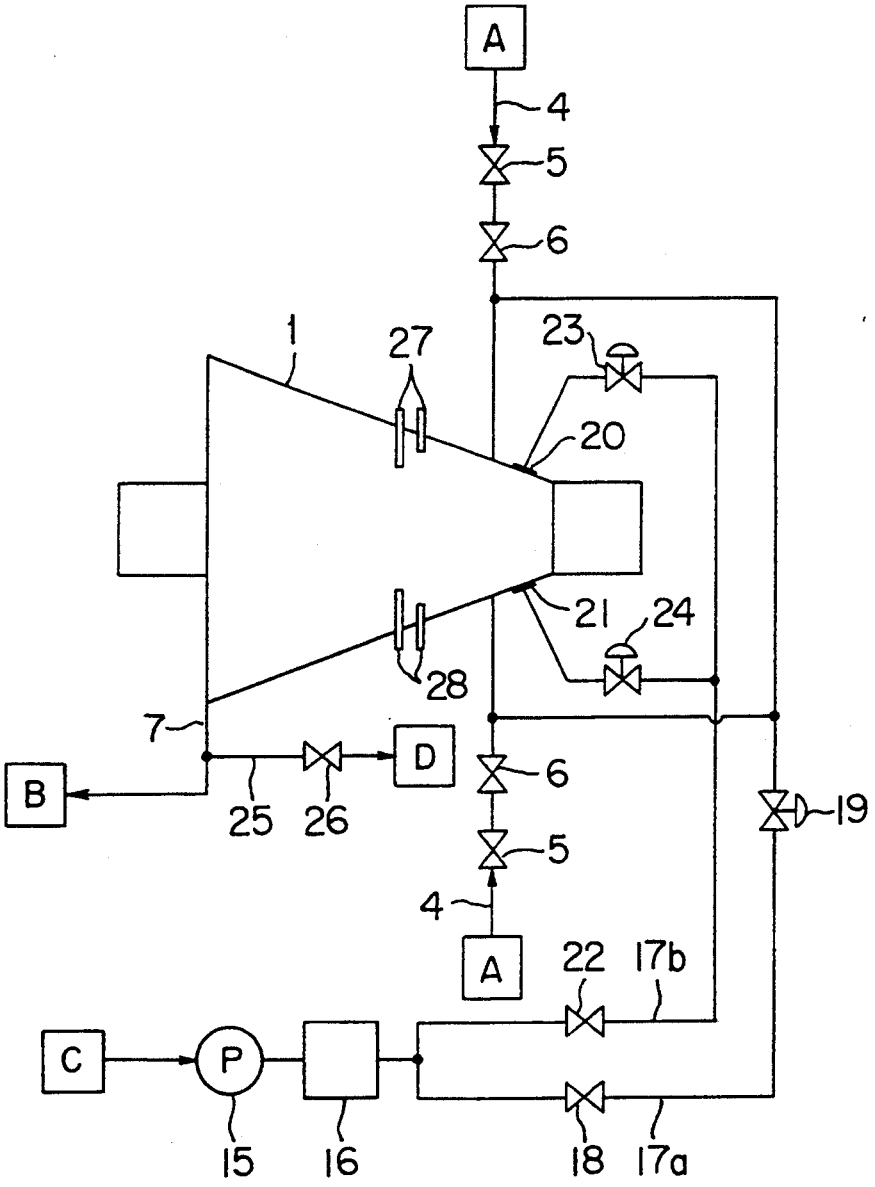
FIG. 1 is a schematic block diagram showing an air duct or line arrangement at a period of forced-air cooling state of a high-pressure turbine of a turbine system according to a first embodiment of the present invention.

A first embodiment of the present invention will be described hereunder with reference to FIG. 1 showing a cooling air duct or line arrangement adapted to a high-pressure turbine of a turbine system.

Referring to FIG. 1, reference numeral 15 denotes an air blower serving for supplying a cooling air C from the atmosphere to inside of a high-pressure turbine 1 through a filter means, not shown, to thereby increase pressure of the air. A heat exchanger 16 connected to the air blower 15 carries out a heat exchanging operation with respect to the thus compressed air so as to produce cooling air of a temperature sufficiently lower than the metal temperature of the casings in a range so as not to cause an excessive thermal stress inside the turbine 1.

The outlet side of the heat exchanger 16 is branched in two lines 17*a* and 17*b*, one 17*a* being connected through a main steam stop valve 5 and a control valve 6 to a main steam line 4 on an outlet side of a steam control valve and the other 17*b* being connected to an upper cooling air charging port 20 provided for the upper half of an high-pressure outer casing 12 (see FIG. 2) of the high-pressure turbine 1 and to a lower cooling air charging port 21 provided for the lower half of the outer casing 12. A stop valve 18 and a flow rate control valve 19 are provided for the connection line 17*a*, and a stop valve 22 and flow rate control valves 23, 24 are provided for the connection line 17*b*. Both the stop valves 18 and 22 are opened just before the starting of a forced-air cooling operation.

The flow rate control valve 19 serves to control the flow rate of the cooling air flowing inside an inner casing 13 of the high-pressure turbine 1, i.e. a steam flow passage, disposed inside the outer casing 12. The flow rate control valve 23 serves to control the flow rate of the cooling air passing the upper half side of the inner and outer casings 12, 13, and the flow rate control valve 24 serves to control the flow rate of the cooling air passing the lower half side of the inner and outer casings 12, 13.

To a high-pressure exhaust line 7 connected to the high-pressure turbine 1 is connected a cooling air discharging line 25 provided with a cooling air discharge valve 26 which are operated at a period of cooling the high-pressure turbine 1, and the cooling air charged into the high-pressure turbine 1 by means of the air blower 15 is discharged through a cooling air discharge port D by opening the cooling air discharge valve 26.

A thermocouple 27 for detecting the metal temperature of the upper half of the casings 12, 13 is provided for the high-pressure turbine 1 to detect a temperature in the upper half space between the high-pressure outer casing 12 and the high-pressure inner casing 13, and a thermocouple 28 for detecting the metal temperature of the lower half of the casings 12, 13 is also provided for the high-pressure turbine 1 to detect the temperature in the lower half space between the high-pressure outer casing 12 and the high-pressure inner casing 13.

Figure 10:
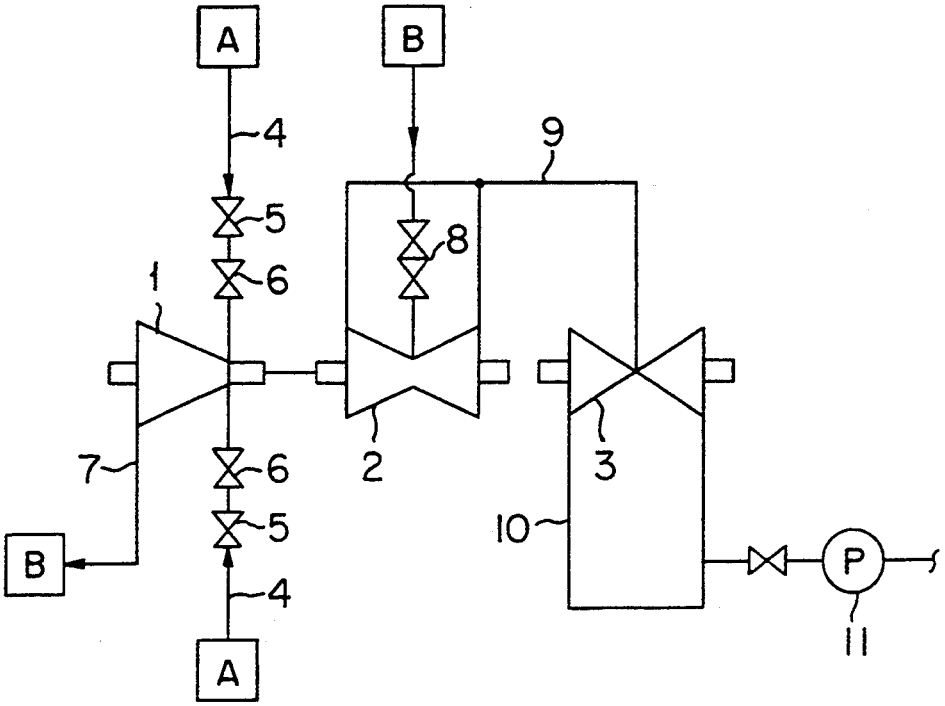
FIG. 10 is a schematic block diagram showing an arrangement of a conventional turbine system.
Figure 11:
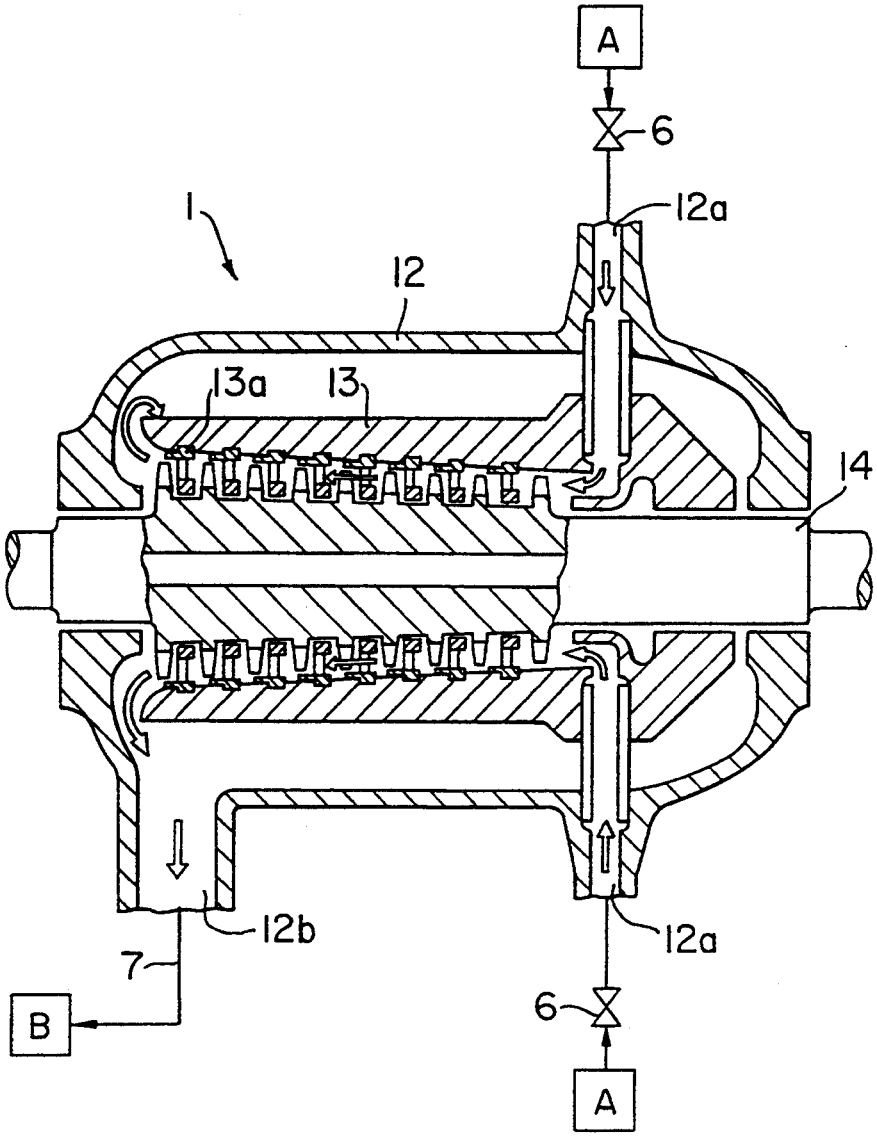
FIG. 11 is a sectional view of the high-pressure turbine of FIG. 10 for explaining the steam flow inside the turbine during a steady operation period thereof.

Further, with reference to the first embodiment shown in FIG. 1, the compressed air by the air blower 15 is charged into the turbine, but, on the contrary, in a case where the air is drawn into the turbine by keeping a vacuum condition inside the turbine, the cooling air discharge port D may be connected to a vacuum pump 11 such as shown in FIG. 10 or ejector in place of the location of the air blower 15.

Figure 2:
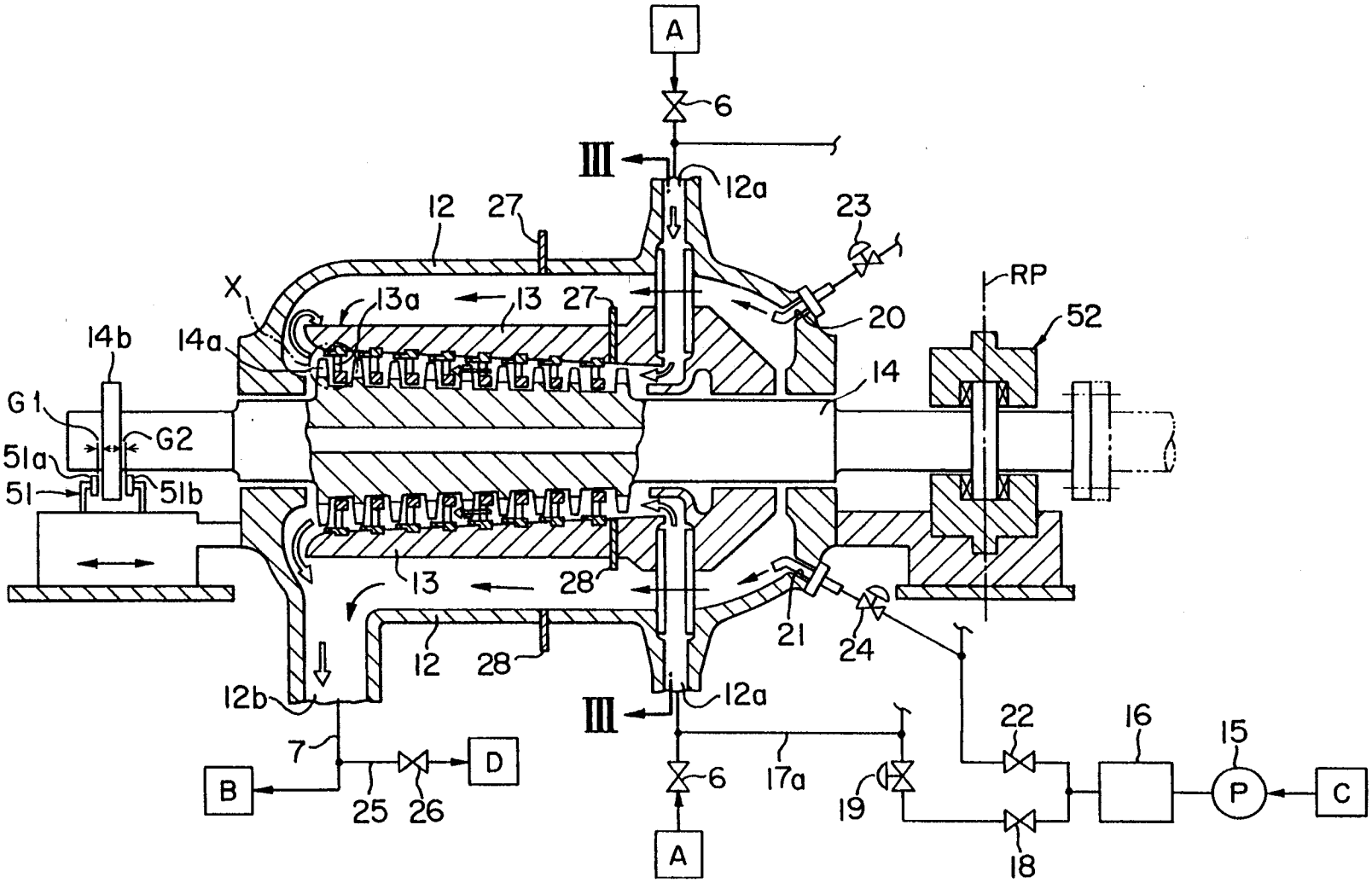
FIG. 2 is a sectional view of the high-pressure turbine of FIG. 1 for explaining the cooling air flow inside the turbine.

According to the forced-air cooling system of the structure shown in FIG. 1, as shown in FIG. 2 with black arrows, the cooling air flows, after opening the stop valves 18 and 22, through the flow rate control valve 24 from the cooling air upper inlet port 20 and the cooling air lower inlet port 21 into the cooling air flow passage (second cooling passage) formed by the outer casing 12 and the inner casing 13 of the high-pressure turbine 1.

Furthermore, as shown in FIG. 2 with white arrows, the cooling air is charged from the main steam inlet port 12*a* through the flow rate control valve 19 and then flows through a steam flow passage (first cooling passage as main cooling passage) formed by the inner casing 13 of the high-pressure turbine 1 through nozzles 13*a*. As this result, the high-pressure turbine 1, in particular turbine blades 14*a* provided on a rotor 14, is rapidly cooled, and the cooling air is thereafter discharged through the cooling air discharge valve 26. The steam control valve 6 is closed during this forced-air cooling operated.

Figure 3:
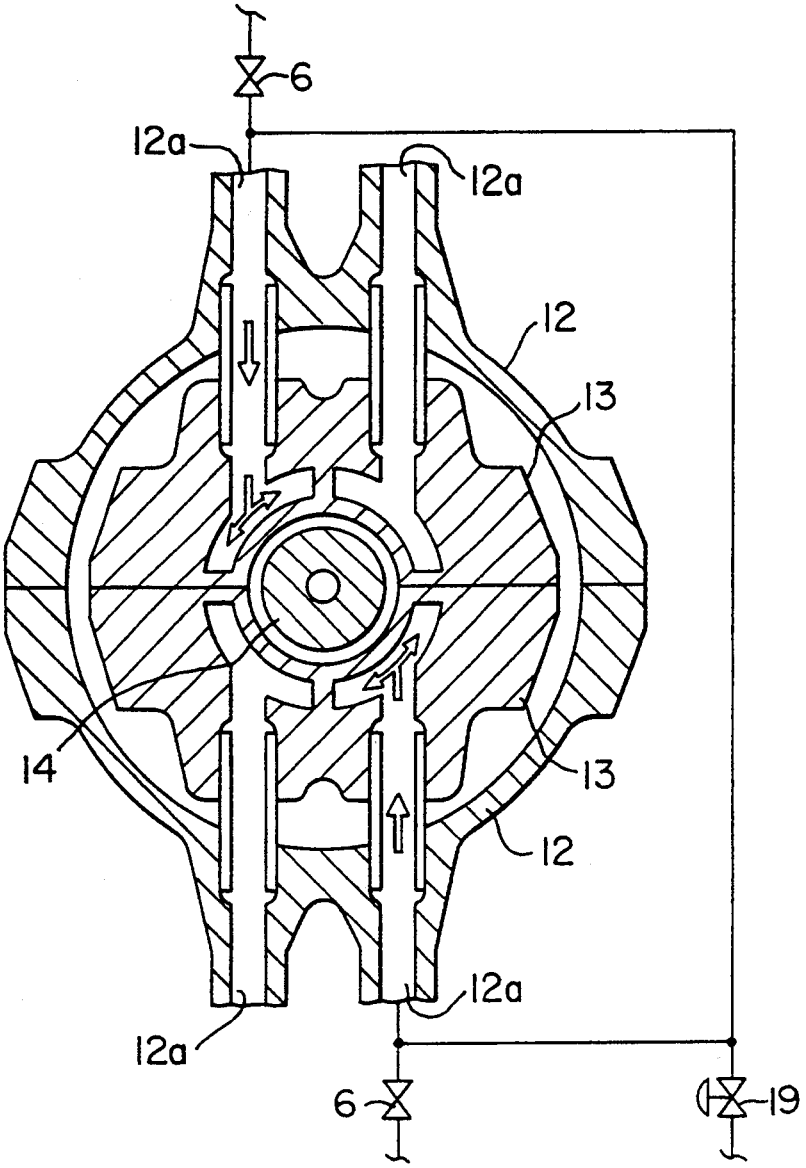
FIG. 3 is a sectional view taken along the line III—III in FIG. 2.

The outer and inner casings 12 and 13 described with reference to FIG. 2 each has a cross section shown in FIG. 3, taken along the line III—III of FIG. 2. As shown in FIG. 3, the cooling air upper half inlet ports 20 are formed respectively to upper bilateral portions of the outer casing 12, and on the other hand, the cooling air lower half inlet ports 21 are formed respectively to lower bilateral portions of the outer casing 12, thereby uniformly charging the cooling air in the high-pressure turbine 1.

Figure 4:
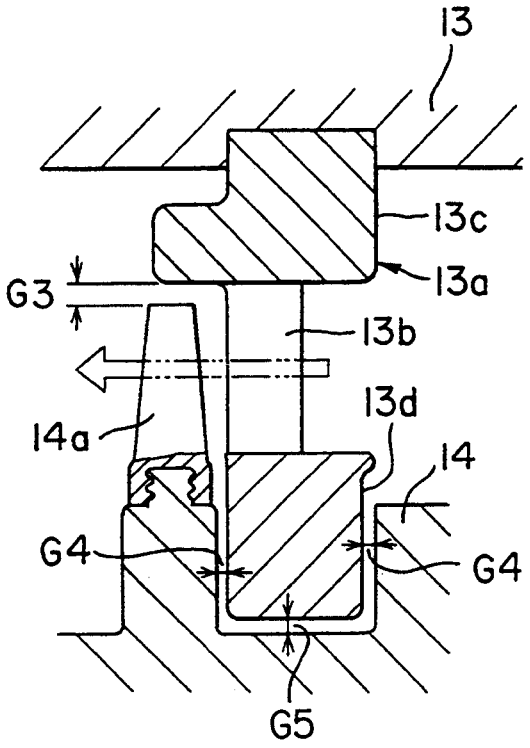
FIG. 4 is a partial enlargement sectional view of portion A as shown in FIG. 2.

As shown in FIG. 4 which is a partial enlargement sectional view of portion X of FIG. 2, the turbine blades 14*a*, as a movable portion, are inserted into the peripheral portion of the rotor 14 with a predetermined distance therebetween in an axial direction and protruded in a row into a radial direction. On the inner surface of the inner casing 13, the annular nozzles 13*a*, as a stationary portion, are provided and protruded into a radial direction. Each nozzle 13*a* consists of an outer supporting ring 13*a* inserted into the inner casing 13 and an inner supporting ring 13*d* arranged coaxially with the outer supporting ring 13*a* and connected by a plural number of nozzle partitions 13*b* therewith. Here, reference signs G3, G4 and G5 denote normal clearances existing between the end and radial peripheral portions of the rotor 14 and the inner casing 13. In a normal condition, G3 and G5 may be 1.12 mm while G4 may be 3.5 mm. In the forced-air cooling operation, the cooling air is primarily charged into the first cooling passage and then passes through the nozzle partitions 13*b* and the blades 14*a* as shown with a white arrow in FIG. 4 thereby cooling the rotor 14 and the inner casing 13. About 90 percent of the total air following into the inner and outer casings follows into the first cooling air passage during the forced-air cooling operation.

In addition, the rotor 14 with thrust bearing 52 is mounted on journal bearings (not shown). Proximity to a flange 14*b* provided the end of the rotor 14, a differential expansion detection means 51 is provided integrally with the outer casing 12. Thus, the detection means 51 moves in an axial direction with an expansion of the outer casing 12.

In order to detect a differential expansion in an axial direction between the rotor 14 and the casings 12, 13 due to the different cooling effect therebetween, detecting sensors 51*a*, 51*b* are located proximity to the flange 14*b* of the rotor 14 with clearances G1, G2. In a normal condition, an expansion set value of G1, G2 is determined in accordance with the reference point (RP) which is set at the center in an axial direction in the thrust bearing 52. Thus, under the forced-air cooling operation, the clearances G1 and G2 can be detected by the differential expansion detection means 51 to generate a signal for representing the difference and comparing with the predetermined expansion set value.

A control unit for controlling the above operations will be described hereunder with reference to the functional block diagram of FIG. 5.

Figure 5:
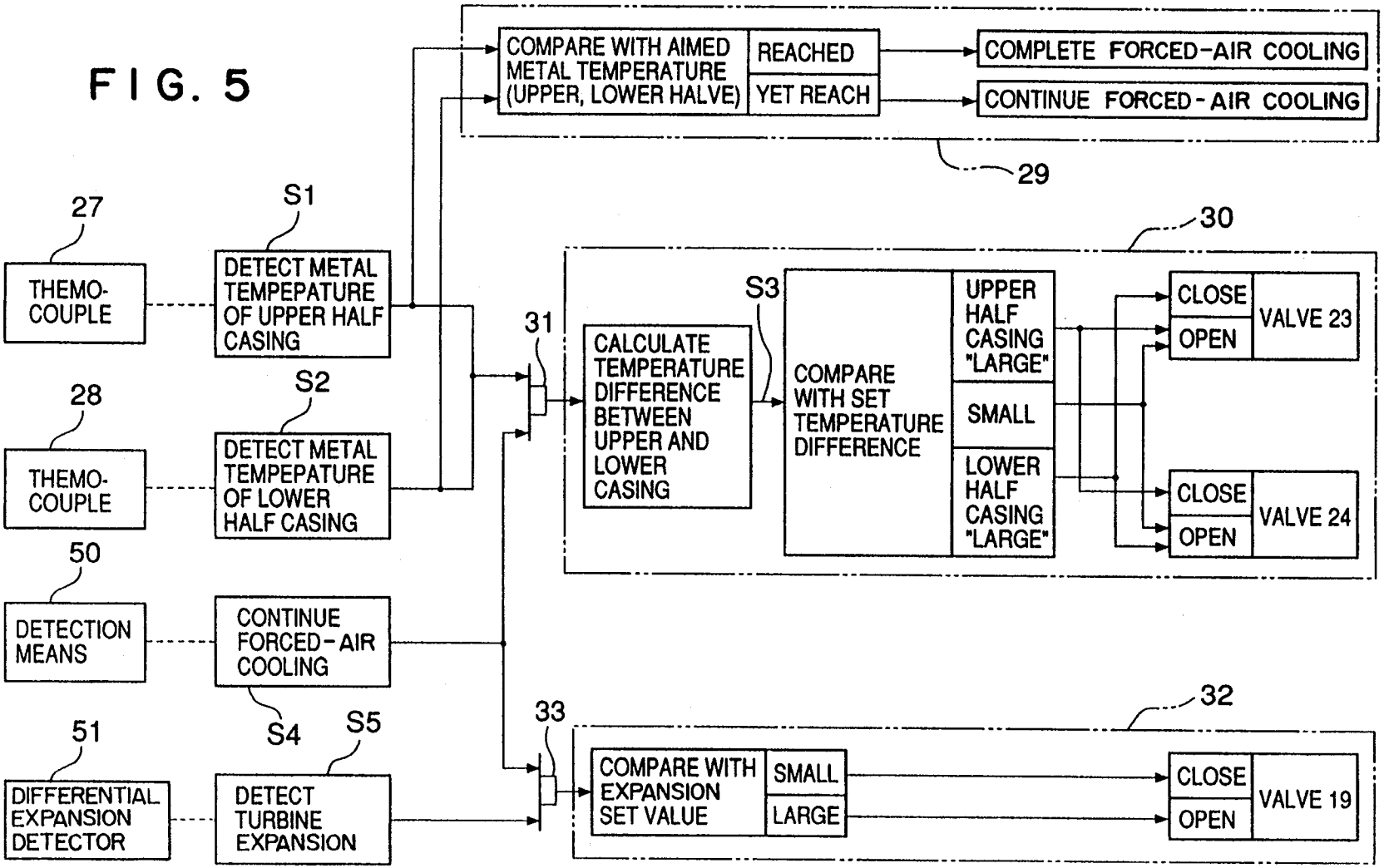
FIG. 5 is a functional block diagram showing a controlling flow of the first embodiment.

Referring to FIG. 5, the forced-air cooling apparatus of the first embodiment includes a control unit including control sections 29, 30 and 32. The control section 29 is operatively connected to the thermocouples 27 and 28 which generate high-pressure turbine upper half and lower half metal temperature detection signals S1 and S2, respectively. The control section 29 performs, in response to these signals S1 and S2, the completion or continuation of the forced-air cooling operation. The control section 30 is also operatively connected to the thermocouples 27 and 28, and the temperature detection signals S1 and S2 from these thermocouples 27, 28 are inputted into this control section 30 as an AND signal through an AND circuit 31, which outputs the AND signal in response to the signals S1 and S2 and a signal S4 representing the forced-air cooling continuation command, which is generated from a detection means 50 for determining whether or not the forced-air cooling should be continued. In response to the AND signal from the AND circuit 31, the control section 31 calculates the metal temperature difference between the upper and lower half portions of the turbine casing. This temperature difference is outputted as a temperature difference signal S3 which is given to the flow rate control valves 23, 24 to thereby control them. The control section 32 is operatively connected, through an AND circuit 33, to the detection means 50 for generating the forced-air cooling continuation signal S4 and a detection means 51 for generating a signal S5 representing a difference with an expansion set value in expansion of the high-pressure turbine. The AND circuit 33 transmits an AND signal to the control section 32 in response to these signals S4 and S5. The AND signal is compared with a preset value, and the control section 33 controls the flow rate valve 9 in response to a deviation in this comparison.

The control function flow of the control unit of the structure described above is as follows.

The cooling air flowing inside the inner casing 13, i.e. the steam flow passage, as shown in FIG. 2 with white arrows, first cools the inside of the inner casing 13 and the high-pressure rotor 14 and then is discharged through the cooling air discharge line 25 and the cooling air discharge valve 26. In this state, when a large volume of cooling air flows, the temperature lowering speed of the high-pressure rotor 14 becomes higher than that of the casing, whereby the thermal expansion of the rotor is faster reduced, causing a so-called rotor short phenomenon. In such case, the detection means 51 generates a large high-pressure differential expansion detection signal S5 to the control section 32 through the AND circuit 33. In the control section 32, this signal S5 is compared with the predetermined set differential expansion value, and in this comparison, in a case where the difference is small, the flow rate control valve 19 is throttled. According to this control operation, the amount of the cooling air flow shown with white arrows in FIG. 2 is reduced, thus solving the rotor short condition. On the other hand, in a case where the rotor temperature lowering speed becomes lower than that of the casing, a so-called rotor long condition, the difference between the signal S5 and the set value becomes large. In such case, the flow rate control valve 19 is opened to increase the flow rate of the cooling air shown-with white arrows, thus solving the rotor long condition.

As described above, since the rotor 14 has a weight less than that of the casing and is provided with the blades 14*a*, the thermal conductivity during the turning operation of the rotor 14 becomes improved, thus being easily cooled. Accordingly, the air amount for cooling the rotor, that is, the cooling air amount flowing in the steam flow passage is made smaller than the cooling air flow rate passing the outer and inner casings.

Further, with reference to FIG. 2, the cooling air passing the flow rate control valve 23 mainly flows, as shown with black arrows, in the upper half casing and cools the inner surface of the upper half of the outer casing 12 and the outer surface of the lower half of the inner casing 13. After cooling the upper half of the casing, the cooling air is discharged into the atmosphere through the cooling air discharge line 25 and the discharge valve 26. The cooling air passing the flow rate control valve 24 mainly flows in the lower half casing and cools the inner surface of the lower half of the outer casing 12 and the outer surface of the upper half of the inner casing 13. After cooling the lower half of the casing, the cooling air is discharged into the atmosphere through the cooling air discharge line 25 and the discharge valve 26. The cooling air flowing between the upper and lower casings 12 and 13 amounts to approximately 10% of the total flows flowing into the turbine 1.

The temperatures of the upper half side and the lower half side of the outer casing are detected by the upper half metal temperature detection thermocouple 27 and the lower half metal temperature detection thermocouple 28, from which the temperature detection signals S1 and S2 generated are transmitted to the control section 30 through the AND circuit 31. In the control section 30, the difference in temperature between the upper and lower halves is calculated and the calculated value is compared with the predetermined set temperature difference. In this comparison, when the temperature difference of the upper half is large, the flow rate control valve 23 is opened and the flow rate control valve 24 is closed, whereas when this temperature difference is small, the flow rate control valve 23 is closed and the flow rate control valve 24 is opened. Further, when the temperature difference of the lower half is large, the flow rate control valve 23 is closed and the flow rate control valve 24 is opened. According to this control operation, the deforming of the casing can be suppressed so as to prevent to contact between the movable portion such as blades of the rotor and the stationary portion such as nozzles.

The temperature signals S1 and S2 representing the metal temperatures of the upper half side and the lower half side of the outer casing are transmitted from the upper half metal temperature detection thermocouple 27 and the lower half metal temperature detection thermocouple 28 are inputted into the control section 29. In this control section 29, the temperatures represented by these signals are compared with predetermined set target (aimed) metal temperatures. In this comparison, when the temperatures represented by these signals S1 and S2 do not yet reach the target metal temperatures, the forced-air cooling is continued, and on the contrary, when the temperatures represented by these signals S1 and S2 reach the target metal temperatures, the forced-air cooling has been completed.

Figure 6:
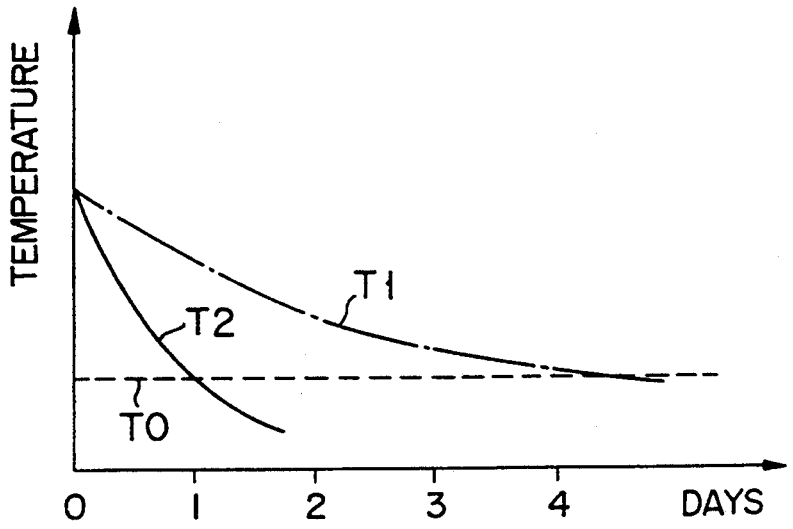
FIG. 6 is a graph showing comparison between the first embodiment and a conventional example.

One example of the cooling speed mode for the turbine is shown in FIG. 6, in which one dot and dash line T1 shows the relationship between temperature and the cooling speed in the case of conventional natural cooling of the turbine, solid line T2 shows the same relationship in the case of the cooling according to the present invention, and broken line T0 shows a temperature allowing dismantling the turbine, which is usually in a range of 150–200° C. Numeral 0 in the abscissa axis represents the period at which the turbine operation is shutdowned.

As shown in FIG. 6, according to this embodiment, the turbine can be cooled to a temperature capable of being dismantled only after about one day cooling, whereas, in conventional natural cooling, about four days were required for cooling of the turbine.

Furthermore, according to this embodiment, the rotor never come in contact with the stationary portion such as a nozzle, due to the difference in their thermal expansions, in the axial direction of the high-pressure turbine during the turning operation, and the rotor, the nozzle and the labyrinth packing do not come in contact each other in the radial direction by the deforming of the casing due to the temperature difference between the upper and lower casing halves. Therefore, it is not necessary to charge cooling air of a temperature slightly lower than the metal temperature, which is carried out in the conventional technique, and cooling air having a low temperature can be charged to thereby cool the turbine rapidly in comparison with conventional natural cooling, thus the periods or days for cooling the turbine are generally reduced and the period required for dismantling the turbine for inspection or maintenance is also shortened.

Figure 7:
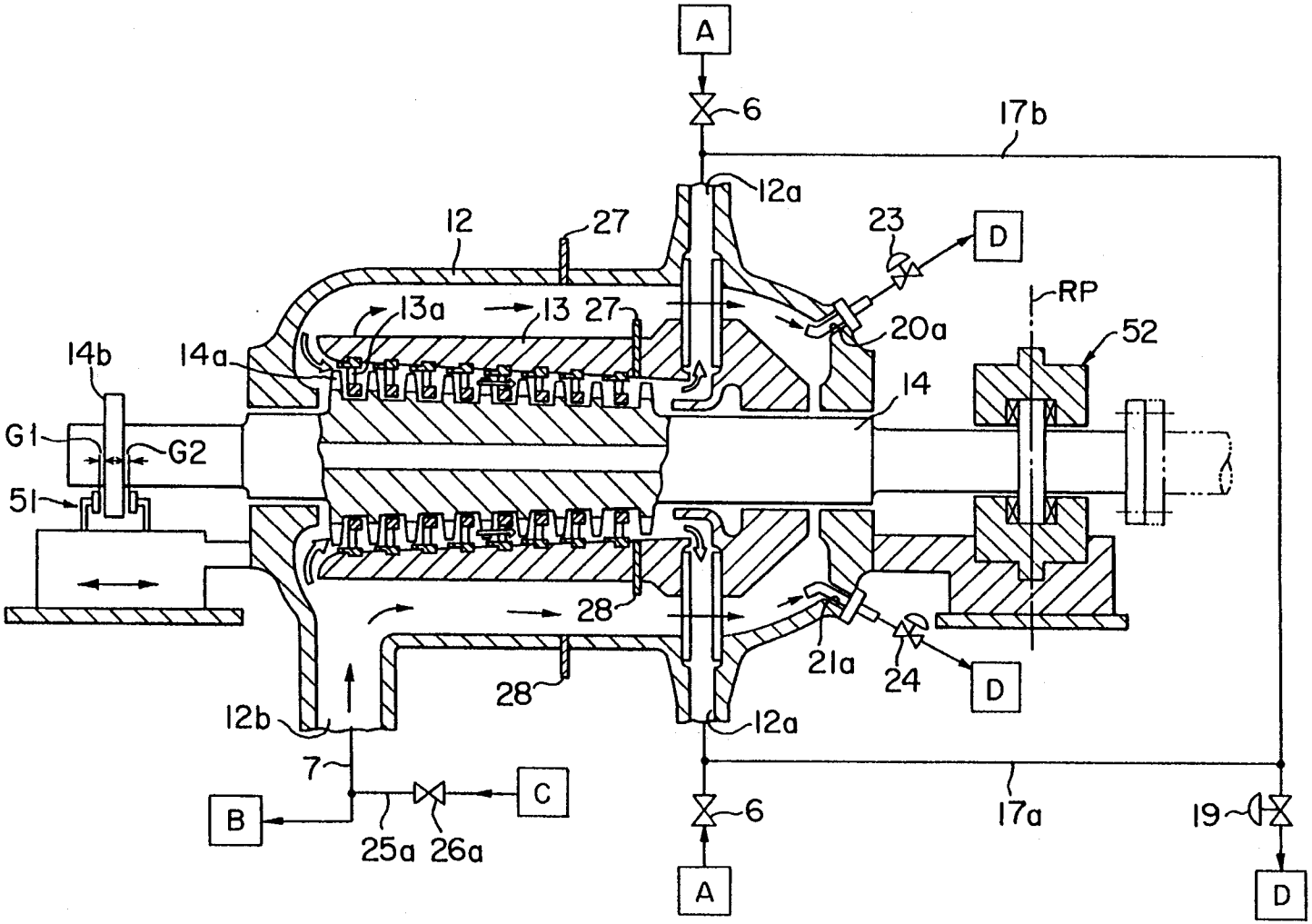
FIG. 7 is a view similar to that of FIG. 2 but related to a second embodiment of the present invention.

A second embodiment of the present invention is represented by FIG. 7, which shows the cooling air flow inside the high-pressure turbine.

This second embodiment differs from the first embodiment in that the cooling air discharge line 25 and the cooling air discharge valve 26 in the first embodiment are alternated to a cooling air inlet line 25*a* and a cooling air inlet valve 26*a*, respectively, through which the cooling air C is charged, and on the contrary, the cooling air upper and lower inlet ports 20 and 21 of the first embodiment are hence alternated to cooling air upper and lower outlet ports 20*a* and 21*a*, respectively.

Namely, the cooling air charged into the turbine outlet portion is branched in two flows at the turbine exhaust port, one being a flow as shown with black arrows in FIG. 5 in which this first flows between the inner and outer casings 12, 13 and is then discharged through the air discharge port provided for the outer casing 12, and the other being a flow as shown with white arrows in which this flows through the steam flow passage in the casing and is then discharged through the air discharge port provided for the steam introducing line. As can be understood from these flows of the cooling air, substantially the same cooling effect as that of the first embodiment shown in FIG. 2 can be achieved. Further, as described above, since the cooling air amount required for cooling the steam flow passage is smaller than that for the space between the inner and outer casings, the cooling air amount can be set in a range for giving no excessive braking force to the rotor now in turning operation period.

Figure 8:
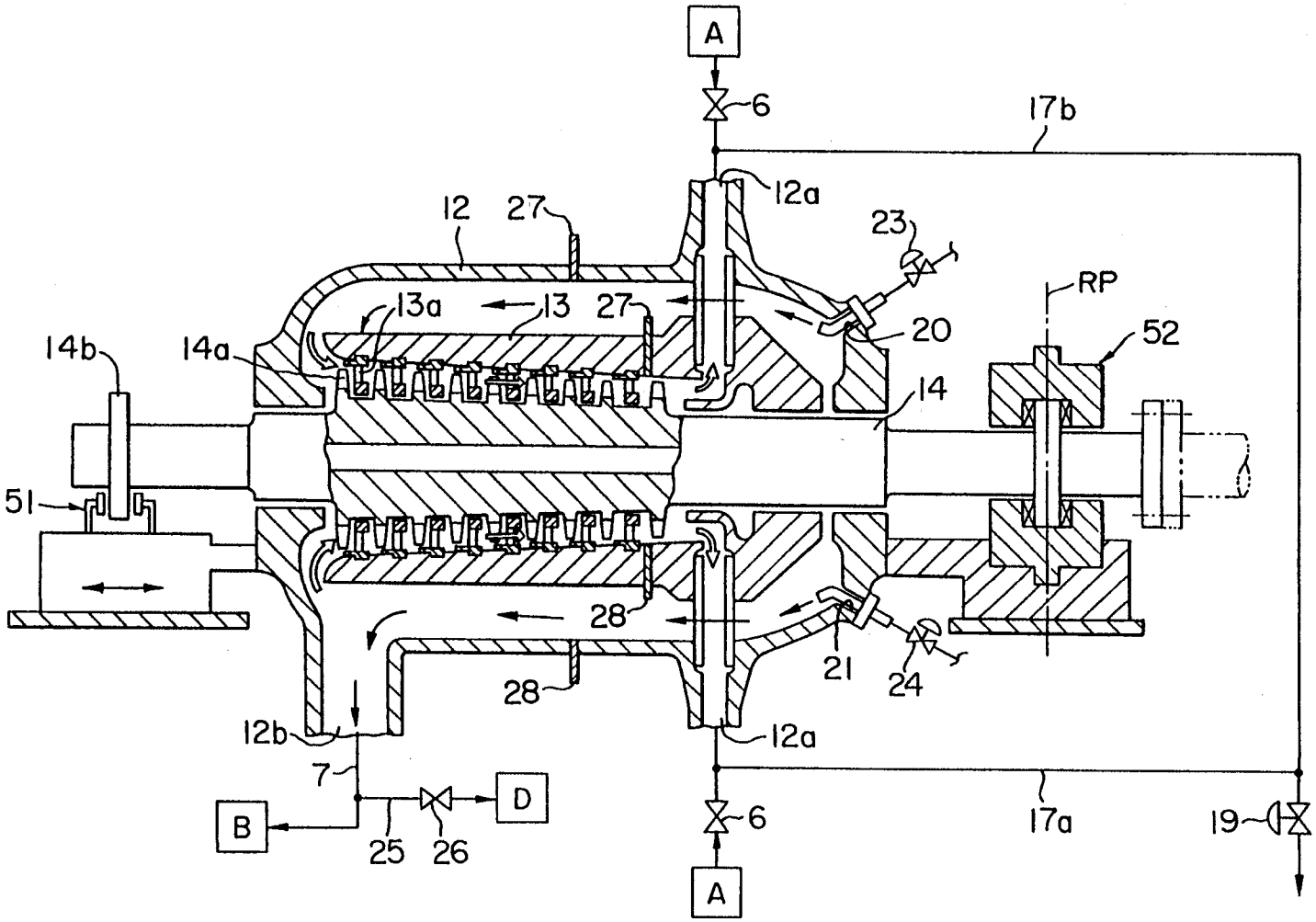
FIG. 8 is a view also similar to that of FIG. 2 but related to a third embodiment of the present invention.

A third embodiment of the present invention is represented by FIG. 8.

This third embodiment differs from the first embodiment in that, in this third embodiment, the air charged from the air inlet port provided for the outer casing flows, as shown with black arrows in FIG. 8, in the space between the inner and outer casings, then turns at an outlet port of the turbine, and then flows, as shown with white arrows, in the steam flow passage. Thereafter, the air is discharged through the air discharge line provided for the steam introducing line, and a portion of the cooling air is discharged through the air discharge line provided for the turbine exhaust line as occasion demands.

Figure 9:
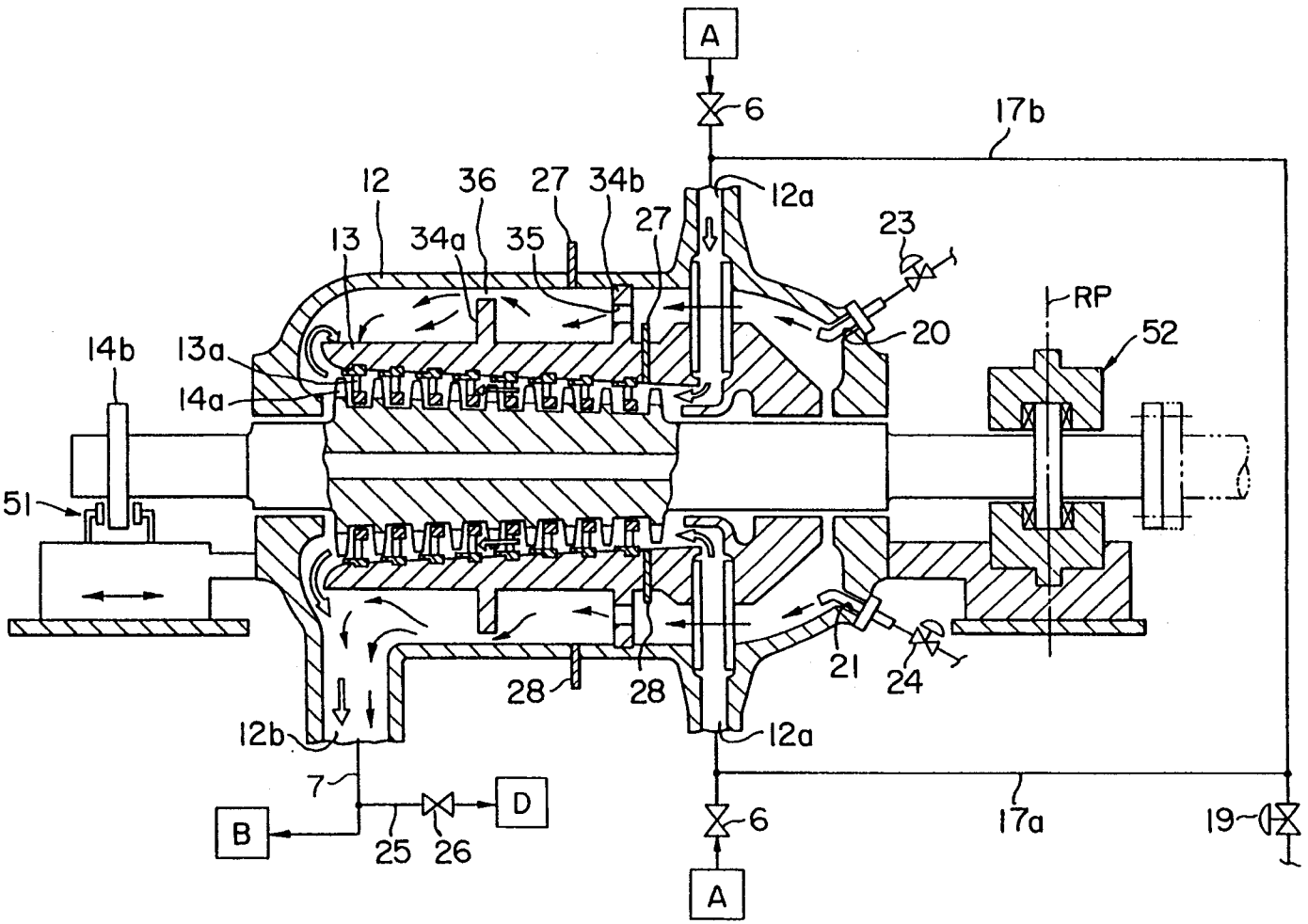
FIG. 9 is a view also similar to that of FIG. 2 but related to a fourth embodiment of the present invention.

A fourth embodiment of the present invention is represented by FIG. 9, in which the turbine has a structure in which the space defined by the inner and outer casings 12, 13 is axially sectioned by a partition plate means. The partition plate means includes partition plates 34*a*, 34*b* each of which is provided with a penetrating portion such as through hole 35 or through slit 36, thereby forming a cooling air passage between the inner and outer casings through the partition plates 34. The contact of the casings with the stationary portions such as nozzle due to the thermal expansion can be prevented by uniformly providing these partition plates 34*a*, 34*b* to the upper and lower casing halves.

As described hereinbefore, according to the present invention, air of low temperature is charged into the turbine so as to prevent the movable portion such as rotor and the stationary portion such as nozzles, from contacting, due to the differential expansion therebetween or the temperature difference between the upper and lower half casing portions. Accordingly, the periods required for cooling the turbine for dismantling can be remarkably reduced, thus shortening the period for dismantling for the purpose of the periodic inspection or maintenance of the turbine.

What is claimed is:

1. A forced-air cooling apparatus of a steam turbine which comprises an outer casing composed of upper and lower casing halves, an inner casing composed of upper and lower casing halves and disposed inside the outer casing and a rotor coaxially disposed inside the inner casing for forming a steam flow passage between the inner casing and the rotor and in which steam introduced into the steam flow passage through nozzles provided on the inside of the inner casing from a steam introducing portion is impinged against blades of the rotor to thereby impart a driving force to a movable portion with respect to a stationary portion of a turbine, the steam turbine is cooled during the turning operation period of the steam turbine, and the steam is thereafter exhausted through a steam exhaust portion, the forced-air cooling apparatus comprising:

a cooling passage means including a first cooling air passage formed between the inner casing and the rotor and a second cooling air passage formed between the outer casing and the inner casing;

means for charging external cooling air into the first and second cooling air passages during the turning operation period;

means for externally discharging the cooling air after passing the first and second cooling air passages;

means for detecting a differential expansion in an axial direction between the movable portion and the stationary portion;

means for detecting a temperature difference between the upper and lower casing halves of the outer casing; and a control means for controlling the flow rate of the cooling air passing the first cooling air passage in response to a signal corresponding to the difference from the differential expansion detection means and controlling the flow rate of the cooling air passing the second cooling air passage in response to a signal corresponding to the difference from the temperature difference detection means.

2. The forced-air cooling apparatus according to claim 1, further comprising a first air charging means provided for the steam introducing portion for charging air into the first cooling air passage, an air discharging means provided for the steam exhaust portion for discharging the air externally, and a second air charging means provided for the outer casing for charging the air into the second cooling air passage, the air passing through the second cooling air passage being discharged through the air discharging means.

3. The forced-air cooling apparatus according to claim 1, further comprising an air charging means provided for the steam exhaust portion for charging air into the first cooling air passage, a first air discharging means provided for the steam introducing portion for discharging the air externally, and a second air discharging means provided for the outer casing for discharging air charged through the steam exhaust portion and passing the second cooling air passage, the air passing through the second cooling air passage being discharged through the air discharging means.

4. The forced-air cooling apparatus according to claim 1, further comprising means provided for the outer casing for charging air into the second cooling air passage, the air being then supplied to the first cooling air passage, a first air discharge means provided for the steam introducing portion for discharging the air and a second air discharging means provided for the steam exhaust portion for discharging a portion of the air charged into the second air cooling passage as occasion demands.

5. The forced-air cooling apparatus according to claim 1, wherein said inner casing is provided with a partition plate means for sectioning a space formed by the outer casing and the inner casing, said partition plate means including a partition plate provided with a through hole through which the cooling air passes and another partition plate provided with a slit which the cooling air passes, said through hole and said slit constituting portions of the second cooling air passage.

6. The forced-air cooling apparatus according to claim 1, wherein a first flow rate control valve is disposed for the first cooling air passage for controlling air flow rate in the first cooling air passage, said control means controlling the first flow rate control valve in comparison with a predetermined set value regarding the differential expansion between the movable portion and the stationary portion from said differential expansion detection means and wherein a second flow rate control valve is disposed for the second cooling air passage for controlling cooling air flow rate in the second cooling air passage, said control means controlling the second flow rate control valve comparison with a predetermined set value regarding the temperature difference between the upper and lower casing halves from said temperature difference detection means.

7. The forced-air cooling apparatus according to claim 1, further comprising an air blowing means and a heat exchanger which are disposed for the air charging means, means for detecting the temperature of air from the heat exchanger and means to control the detected temperature.

* * * * *